US007408275B2

(12) United States Patent
Hernandez et al.

(10) Patent No.: US 7,408,275 B2
(45) Date of Patent: Aug. 5, 2008

(54) PREVENTIVE MAINTENANCE TAPPING AND DUTY CYCLE MONITOR FOR VOLTAGE REGULATOR

(75) Inventors: Augusto D. Hernandez, deceased, late of Brookfield WI (US); by Augusto D. Hernandez, Jr., legal representative, New Berlin, WI (US); Donald A. Down, Brookfield, WI (US); Fred J. Rapant, S. Milwaukee, WI (US); Richard J. Kaluzny, Greenfield, WI (US)

(73) Assignee: Cooper Technologies Company, Houston, TX (US)

( * ) Notice: Subject to any disclaimer, the term of this patent is extended or adjusted under 35 U.S.C. 154(b) by 470 days.

(21) Appl. No.: 11/019,527

(22) Filed: Dec. 23, 2004

(65) Prior Publication Data

US 2006/0028185 A1 Feb. 9, 2006

Related U.S. Application Data

(63) Continuation-in-part of application No. 10/927,505, filed on Aug. 27, 2004, now abandoned.

(60) Provisional application No. 60/500,687, filed on Sep. 8, 2003.

(51) Int. Cl.
*H01H 1/50* (2006.01)
*H01H 19/00* (2006.01)
*H01R 39/00* (2006.01)

(52) U.S. Cl. ..... 307/137; 307/81; 200/11 TC; 200/19.03; 200/19.11; 200/38 D; 200/38 F

(58) Field of Classification Search ..... 307/141, 307/81, 137; 200/19.03, 19.04, 19.05, 19.07, 200/19.11, 19.15, 19.31, 38 D, 38 F
See application file for complete search history.

(56) References Cited

U.S. PATENT DOCUMENTS 3,427,530 A * 2/1969 Hartwell et al. ..... 323/256

(Continued)

FOREIGN PATENT DOCUMENTS

WO WO 02/48730 6/2002

OTHER PUBLICATIONS

PCT International Search Report (Application No. PCT/US05/46759) mailed Oct. 2, 2007 (2 total pages).

(Continued)

*Primary Examiner*—Michael J Sherry
*Assistant Examiner*—Hal I Kaplan
(74) *Attorney, Agent, or Firm*—Fish & Richardson P.C.

(57) ABSTRACT

Automatically changing the tap position in a load tap changer includes noting a polarity of a first tap position of a load tap changer. A duration for which one or more consecutive tap positions of the load tap changer collectively have had the noted polarity also is noted. The one or more consecutive tap positions include the first tap position. The duration for which the one or more consecutive tap positions collectively have had the noted polarity is compared to a threshold value. A change is made from the first tap position to a second tap position with a polarity that is different than the noted polarity when the duration for which the one or more consecutive tap positions collectively have had the noted polarity is longer than the threshold value. A change may be made from the second tap position back to the first tap position.

20 Claims, 6 Drawing Sheets

U.S. PATENT DOCUMENTS

| | | | | | |
|---|---|---|---|---|---|
| 3,544,884 | A | * | 12/1970 | Prescott | 323/340 |
| 4,530,607 | A | * | 7/1985 | Bungener | 368/109 |
| 5,179,290 | A | * | 1/1993 | Page | 307/137 |
| 5,450,002 | A | | 9/1995 | Dunk | |
| 5,581,173 | A | * | 12/1996 | Yalla et al. | 323/257 |
| 6,100,674 | A | * | 8/2000 | Dohnal et al. | 323/256 |
| 6,124,726 | A | | 9/2000 | Dohnal et al. | |
| 6,833,518 | B1 | | 12/2004 | Byers et al. | |

OTHER PUBLICATIONS

PCT Written Opinion (Application No. PCT/US05/46759) mailed Oct. 2, 2007 (8 total pages).

* cited by examiner

PREVENTIVE MAINTENANCE TAPPING AND DUTY CYCLE MONITOR FOR VOLTAGE REGULATOR

CROSS REFERENCE TO RELATED APPLICATIONS

This application is a continuation-in-part of U.S. application Ser. No. 10/927,505, filed Aug. 27, 2004, now abandoned and titled "Preventive Maintenance Tapping and Duty Cycle Monitor for Voltage Regulator," which claims the benefit of U.S. Provisional Application No. 60/500,687, filed Sep. 8, 2003, and titled "Step Voltage Regulator: Preventive Maintenance Tapping and Duty Cycle Monitor." Both of these applications are hereby incorporated by reference in their entirety.

TECHNICAL FIELD

This document relates to a system for monitoring and maintaining a load tap changer in a voltage regulator.

BACKGROUND

A voltage regulator or load tap changer utilizes a tap changer that employs a secondary circuit detector to actuate a mechanical linkage that selectively engages taps of a tapped section of winding to maintain a substantially constant voltage on an output of the regulator in response to voltage variations on an input of the regulator. Arcing occurs during changes in the tap position, which results in some erosion of involved contacts. This contact erosion continues until maintenance is performed on the tap changer and the contacts are replaced, or until the contacts erode to a point where the contacts no longer make electrical contact with one another, resulting in an electrical outage. As a result, remaining contact life impacts maintenance schedules and service reliability of the voltage regulator.

A separate phenomenon, known as coking, may occur if the tap changer contacts stay on a particular position for an extended period of time. Coking refers to carbon deposits that form on the tap changer contacts. These deposits shorten contact life and may lead to a premature service interruption. Preventing coking from occurring requires that the tap changer contacts be moved, or 'wiped,' periodically. To prevent coking, the tap changer may be tapped to wipe the carbon deposits from the contacts.

SUMMARY

In one general aspect, automatically changing the tap position in a load tap changer includes noting a polarity of a first tap position of a load tap changer. A duration for which one or more consecutive tap positions of the load tap changer collectively have had the noted polarity also is noted. The one or more consecutive tap positions include the first tap position. The duration for which the one or more consecutive tap positions collectively have had the noted polarity is compared to a threshold value. A change is made from the first tap position to a second tap position with a polarity that is different than the noted polarity when the duration for which the one or more consecutive tap positions collectively have had the noted polarity is longer than the threshold value.

Implementations may include one or more of the following features. For example, noting a duration for which one or more consecutive tap positions collectively have had the noted polarity may include noting the value of a countdown timer. The countdown timer may be reset to the threshold value after a change to a tap position that has a polarity that is not the noted polarity. Comparing the duration for which the one or more consecutive tap positions collectively have had the noted polarity to the threshold value may include determining whether the value of the countdown timer is zero.

Changing from the first tap position to the second tap position may include changing from the first tap position to a second position that is one position from a neutral tap position. A change from the second tap position to the first tap position may be made. In addition, a change may be made from the second tap position to a third tap position that has a polarity that is different from the polarities of the first and second tap positions.

Information indicating the change from the first tap position to the second tap position may be recorded.

A signal indicating that the first tap position is to be changed may be generated when the duration for which the one or more consecutive tap positions collectively have had the noted polarity is larger than the threshold value.

Changing from the first tap position to the second tap position may include noting a present time and checking if the present time is within a specified range of times during which a change in tap position may occur. When the present time is not within the specified range, the present time may be monitored until the present time is within the specified range. A change from the first tap position to the second tap position may be made only after the present time is within the specified range.

Changing from the first tap position to the second tap position may include checking if the first tap position is within a specified range of positions within which a tap change can occur. When the first tap position is not within the specified range, the first tap position may be monitored until the first tap position is within the specified range. A change from the first tap position to the second tap position may be made only after the first tap position is within the specified range.

Changing from the first tap position to the second tap position may include measuring a magnitude of load current flowing through the load tap changer and checking if the magnitude is less than a threshold value. When the magnitude is not less than the threshold value, the magnitude may be monitored until the magnitude is less than the threshold value. A change from the first tap position to the second tap position may be made only after the magnitude is less than the threshold value.

Changing from the first tap position to the second tap position may include verifying that operating conditions of the load tap changer meet criteria for allowing a change in tap position. A change from the first tap position to the second tap position may be made when the criteria are met.

A signal indicating that a change from the first tap position should occur may be received. A change from the first tap position to the second tap position may be made in response to the signal.

In another general aspect, a system for automatically changing the position of movable contacts of a load tap changer includes a processor operable to determine polarities of positions of movable contacts in a load tap changer of a voltage regulator and a duration for which one or more consecutive positions of the movable contacts have had a common polarity. The system also includes an actuator operable to change the position of the movable contacts. The actuator changes the position of the movable contacts in response to a signal from the processor that the position is to be changed because the one or more consecutive positions of the movable contacts have had the common polarity for longer than a threshold value.

Implementations may include one or more of the following features. For example, the processor may access a clock to determine the duration for which the one or more consecutive positions have had the common polarity and to determine if the one or more consecutive positions have had the common polarity for longer than the threshold value.

The system also may include a memory operable to store data specifying the positions of the movable contacts and the changes to the positions of the movable contacts.

The processor may be operable to determine a present time. The processor may signal for a change in the position of the movable contacts if the present time is within a specified daily time period.

The processor may be operable to obtain a measurement of the magnitude of the load current flowing through the voltage regulator. The processor may signal for a change in the position of the movable contacts if the current measurement is below a threshold value.

The processor may be operable to send a signal to a subordinate processor and receive a signal from a superior processor. The processor may send a signal to the subordinate processor before each change in the position of the movable contacts as a result of the one or more consecutive positions having had the common polarity for longer than the threshold value. The signal may instruct the subordinate processor to cause a change in a position of movable contacts associated with the subordinate processor. The processor may receive a signal from the superior processor and may cause a change in the position of the movable contacts in response to the signal.

Other features will be apparent from the following description, including the drawings and the claims.

DESCRIPTION OF DRAWINGS

Like reference symbols in the various drawings indicate like elements.

DETAILED DESCRIPTION

Figure 1:
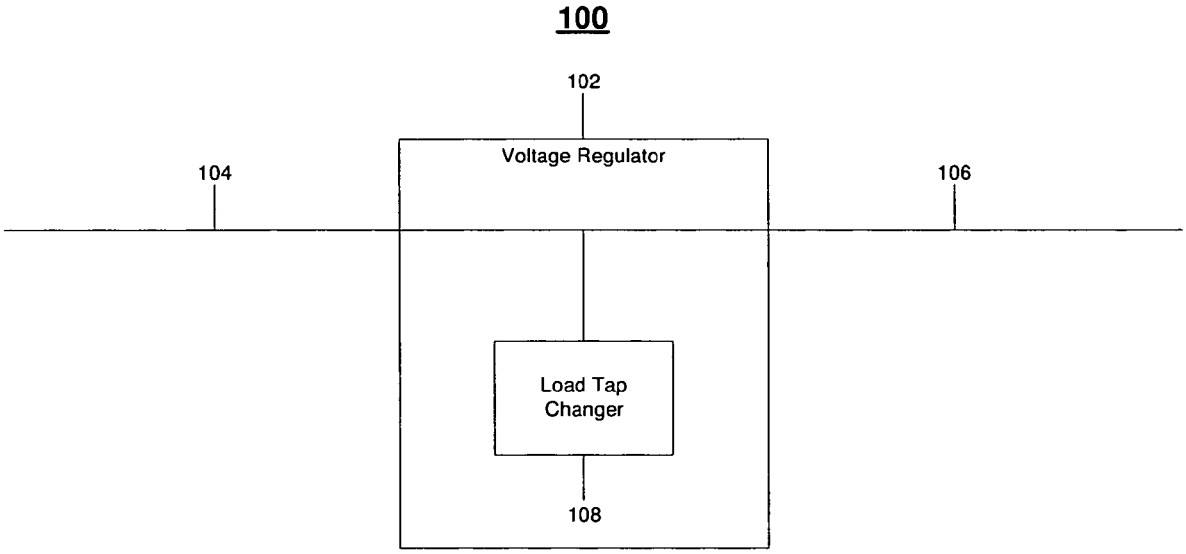
FIG. 1 is a block diagram of an electrical system that includes a load tap changer.

Referring to FIG. 1, an electrical system 100 includes a voltage regulator 102. The voltage regulator 102 monitors the voltage on an output conductor 106 and regulates the voltage on the output conductor 106 to a set level. The output produced by the voltage regulator 102 on the output conductor 106 is a regulated version of the voltage on an input conductor 104. The voltage regulator 102 regulates the voltage of the output by engaging taps of a load tap changer 108 of the voltage regulator 102.

In one implementation, the load tap changer 108 may be a 32-step tap changer that accurately regulates voltage in ⅝% steps from "10% raise" to "10% lower" on distribution circuits rated 2400 volts (60 kV BIL) through 34,500 volts (200 kV BIL) for either 50 or 60 Hz systems. In other implementations, the load tap changer 108 may have a different number of tap positions or a different step size and may be applied to distribution circuits with different ratings.

Figure 2:
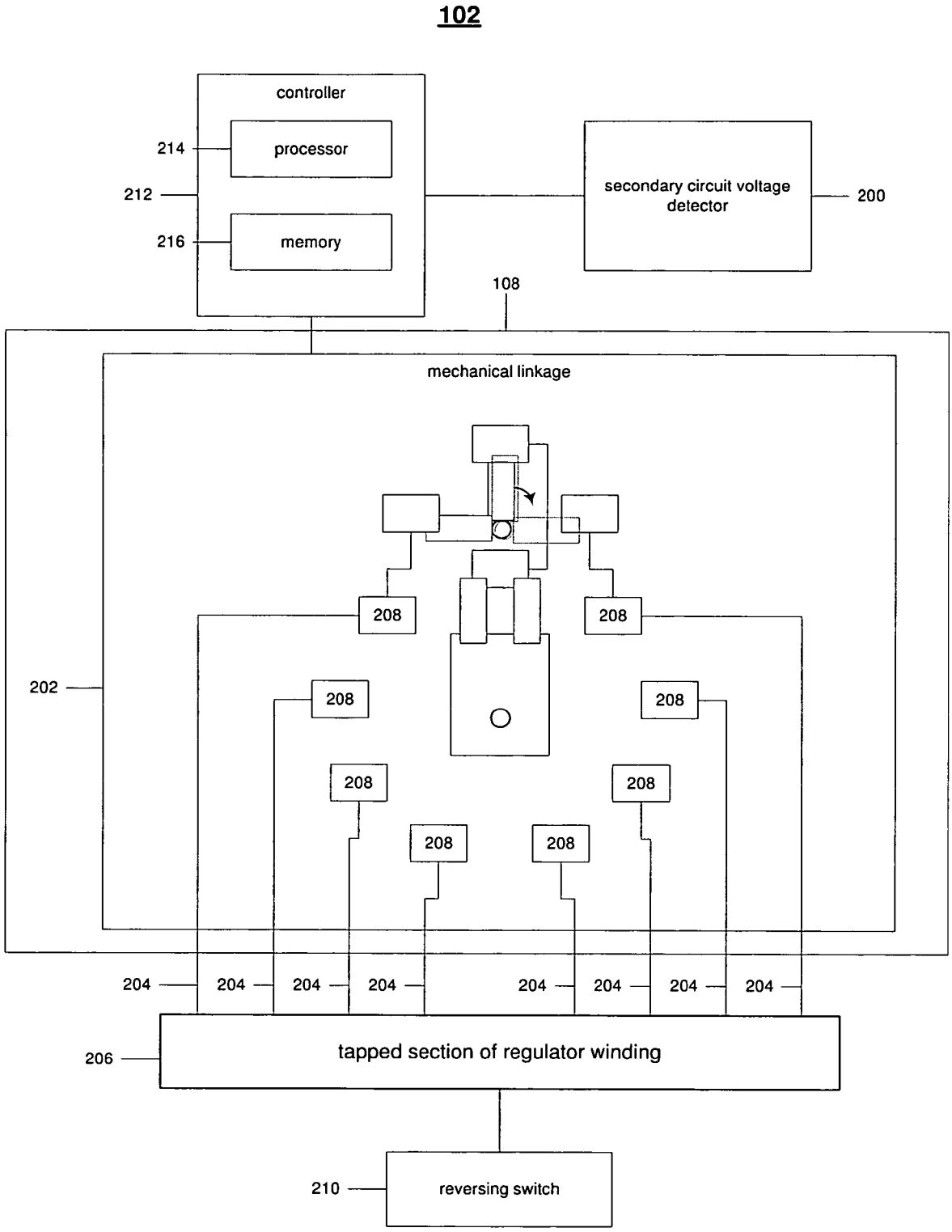
FIG. 2 is a block diagram of a load tap changer.

The voltage regulator 102 uses the load tap changer 108 to control voltage variations due to load changes, or changes to the voltage on the input conductor 104. More particularly, a controller of the voltage regulator 102 uses the load tap changer 108 to control the voltage variations. In other words, the load tap changer 108 may be used to maintain a constant voltage on the output conductor 106 even if the voltage detected on the input conductor 104 changes. As shown in FIG. 2, the load tap changer 108 employs a secondary circuit voltage detector 200 to actuate a mechanical linkage 202 to selectively engage different taps 204 of a tapped section of a winding 206, in response to voltage variations, in order to control the output voltage of the voltage regulator 102. The mechanical linkage 202 includes stationary contacts 208 to which movable contacts of the load tap changer 108 electrically connect to engage the corresponding taps 204. While FIGS. 1 and 2 illustrate a single-phase voltage regulator, tap changers also may be used to control multi-phase systems, such as three-phase systems, and the techniques described below are equally applicable to such systems. In the case of a three-phase system, multiple load tap changers 108 may be used.

In one implementation, the load tap changer 108 may vary the relationship between the input and output voltage of an electrical control device in the range of ±10% from a nominal value. For example, the load tap changer 108 may include sixteen taps 204, each of which adjusts the relationship by ⅝%, such that the total possible adjustment may be up to 10% (that is 16×⅝%). A polarity or reversing switch 210 permits this adjustment to be positive or negative.

The voltage regulator 102 includes a controller 212 that determines when the load tap changer 108 should be used to engage different taps 204 of the winding 206 to control the output voltage of the voltage regulator 102. When such a determination is made, the controller signals the load tap changer 108 to change the tap position, and the load tap changer 108 responds by changing the tap position. The controller 212 receives voltage and current measurements from the voltage regulator 102 to aid in determining when to change the tap position. A current transformer or sensor provides current measurements to the controller 212, and a potential transformer or sensor provides voltage measurements to the controller 212. The current transformer and the potential transformer may be included within the voltage regulator 102 or may be external to the voltage regulator 102. In some implementations, the voltage regulator 102 uses two potential transformers or sensors.

The controller 212 includes a processor 214 that processes machine-executable instructions and a memory 216 that stores information needed by the processor 214. The processor 214 performs calculations based on the current and voltage measurements and other signals, such as tap changer direction, and stores the results of those calculations in the memory 216. The controller 212 runs one or more clock processes that are accessible by other processes running in the controller 212.

The processor 214 executes multiple processes for monitoring and maintaining the load tap changer 108 within the voltage regulator 102. For example, the processor 214 executes a preventive maintenance tapping (PMT) process and a duty cycle monitoring (DCM) process to increase the life of the tap changer 108 and decrease the number of planned or unplanned service interruptions. The preventive maintenance tapping process lengthens contact life by preventing coking from occurring. By calculating erosion-todate and remaining life of the contacts, the duty cycle monitoring process enables better scheduling of maintenance such that maintenance is not performed too often, but is performed often enough to prevent unplanned outages.

The movable contacts of the tap changer 108 may stay in a particular position for extended periods of time when the voltage on the input conductor 104 remains constant, when changes in tap position are explicitly prevented, or for other reasons. As noted above, when the movable contacts remain in one position for such extended periods, coking may occur. Manual tap changes may be made in an attempt to extend the contact life, but these changes are made without the knowledge of the duration of tap changer inactivity.

Figure 3:
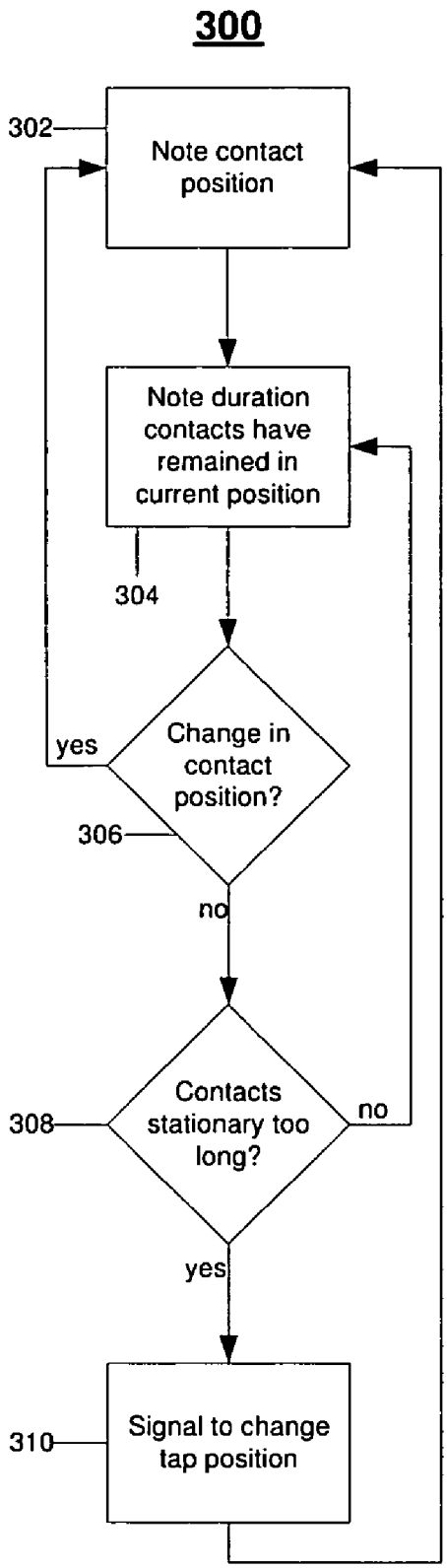
FIGS. 3 and 5 are flow charts of processes for preventive maintenance tapping in a load tap changer.

Referring to FIG. 3, in order to prevent carbon buildup on the movable contacts, a preventive maintenance tapping process 300 causes the tap position to change after a set of criteria, including the time of tap changer inactivity, are met. The process 300 is executed by, for example, the processor 214 of the controller 212. The process 300 signals for a change in tap position when the tap changer has been in one tap position for longer than a threshold amount of time.

Initially, the present position of the load tap changer contacts is noted (302), and the duration for which the contacts have been at that position is monitored (304). For example, in one implementation, countdown timers are used to monitor the time period during which the contacts have been in one tap position. In one implementation, the timers indicate an amount of time in days remaining before the tap position should be changed. The countdown timers may be initially set to the maximum time allowed between tap changes, which, in the noted implementation, is a configurable parameter that can take on any number of whole days between 1 and 99 (though other implementations may use other values and ranges). The countdown timers are accessible by way of the human-machine interface (HMI) and the communication interface of the controller.

If the tap position is subsequently changed (306), due to a variation in the input voltage or output voltage of the voltage regulator, or for other reasons, the new contact position is noted (302). The countdown timer is reset to the maximum time allowed between tap changes and is used to monitor the duration for which the tap changer has not changed position (304).

If no change in the position of the tap changer is detected, but the tap changer has been at its present position for less than the time limit (308), the process 300 continues to monitor the time for which the tap changer has been at its present position. In general, a countdown timer having a nonzero value indicates that the tap changer has been at its present position for less than the time limit.

If the movable contacts of the tap changer have remained in one position for more than the time limit (308) (i.e., the countdown timers have zero values), the processor 214 causes the controller 212 to signal for a preventive maintenance tapping sequence that causes a change in the tap position (310). In general, the preventive maintenance tapping sequence causes a change in tap position from an original position through one or more other tap positions back to the original position. Returning to the original position enables the tap changer to continue operating normally after the preventive maintenance tapping sequence. The one or more other positions through which the tap position is moved may be indicated by a particular mode that governs how the tap position is changed. The particular mode that is used may be indicated by conditions of the tap changer that caused the preventive maintenance tapping sequence. Each mode may be independently turned off and on, such that any number of the modes may be used. Before the preventive maintenance tapping sequence begins, the time, date and mode to be used are recorded by the controller 212.

In one implementation, a simple mode, called mode A, limits maintenance tapping to a range not to exceed one tap higher or one tap lower than the initial tap position. Let N be the tap changer position when a preventive maintenance tapping sequence is starting according to the simple mode A. In one implementation of the simple mode, the tap is raised to position N+1, and then is lowered to position N−1 before being returned to the initial position N. In another implementation of the simple mode, the tap is raised to position N+1, and then is returned to the initial position N. In yet another implementation of the simple mode, the tap is lowered to position N−1 before being returned to the initial position N. In general, the simple mode may be used to move the tap changer into a non-restricted tap position before returning to the initial position.

A more complex mode, called mode B, is intended to operate the tap changer's internal reversing switch as long as a series of criteria have been met. When mode B is selected and a preventive maintenance tapping sequence is started, the tap changer position is moved through a neutral position to operate the reversing switch. The number of positions through which the tap changer moves depends on the initial tap position. For example, if the tap position initially represents a raise from the neutral position, the tap position will be lowered to one step below the neutral position before being raised back to the original position. On the other hand, if the tap position is initially in a position lower than the neutral position, the tap position will be raised to one step above the neutral position before being lowered back to the original position. If the tap position is initially in the neutral position, the tap position is moved one position above the neutral position and then one position below the neutral position before the tap position is returned to the neutral position. More generally, mode B itself does not limit the positions of the load tap changer to which the tap may be moved. However, other conditions, parameters, and components of the tap changer, such as limit switches of a position indicator of the tap changer, may limit the positions to which the tap may be moved. These sequences of movements are all designed to operate the reversing switch in the load tap changer, thereby abrading carbon deposits, which result from coking, from the contacts of the reversing switch.

The preventive maintenance tapping process 300 employs a configurable time-of-day range parameter that defines the acceptable time frame during which a preventive maintenance tapping sequence may be initiated. If the countdown timer expires during a period of time that is not within the time-of-day range parameter, the preventive maintenance tapping sequence that has been signaled remains pending until a time of day within the time of day range parameter is reached. The time of day range parameter includes a start time and an end time. In one implementation, the times may take values within the range between 00:00 to 23:59 that represent valid times. The start time defines the beginning of the range of times during which a preventive maintenance tapping sequence may be initiated, and the end time defines the end of the range.

A second parameter used by the preventive maintenance tapping process 300 is the maximum deviation from the neutral position parameter, which defines the absolute value of the outer tap position limits, beyond which the controller will not initiate a mode B preventive maintenance tapping sequence. For example, if the maximum deviation from the neutral position parameter is set to 5 and the tap changer is at a tap position of −7, the preventive maintenance tapping sequence that has been signaled will remain pending until the tap changer has taken a position within the range allowed by the maximum deviation from the neutral position parameter, which is −5 to +5 in this case. For a load tap changer having 16 taps, the maximum deviation from the neutral position parameter may take an integral value between 1 and 16.

A current limit parameter may also be considered when executing a preventive maintenance tapping sequence. The current limit parameter prevents the initiation of a preventive maintenance tapping sequence when the load current exceeds the indicated threshold. This user-configurable parameter takes the form of a percentage of the maximum rated load current of the voltage regulator.

Figure 4:
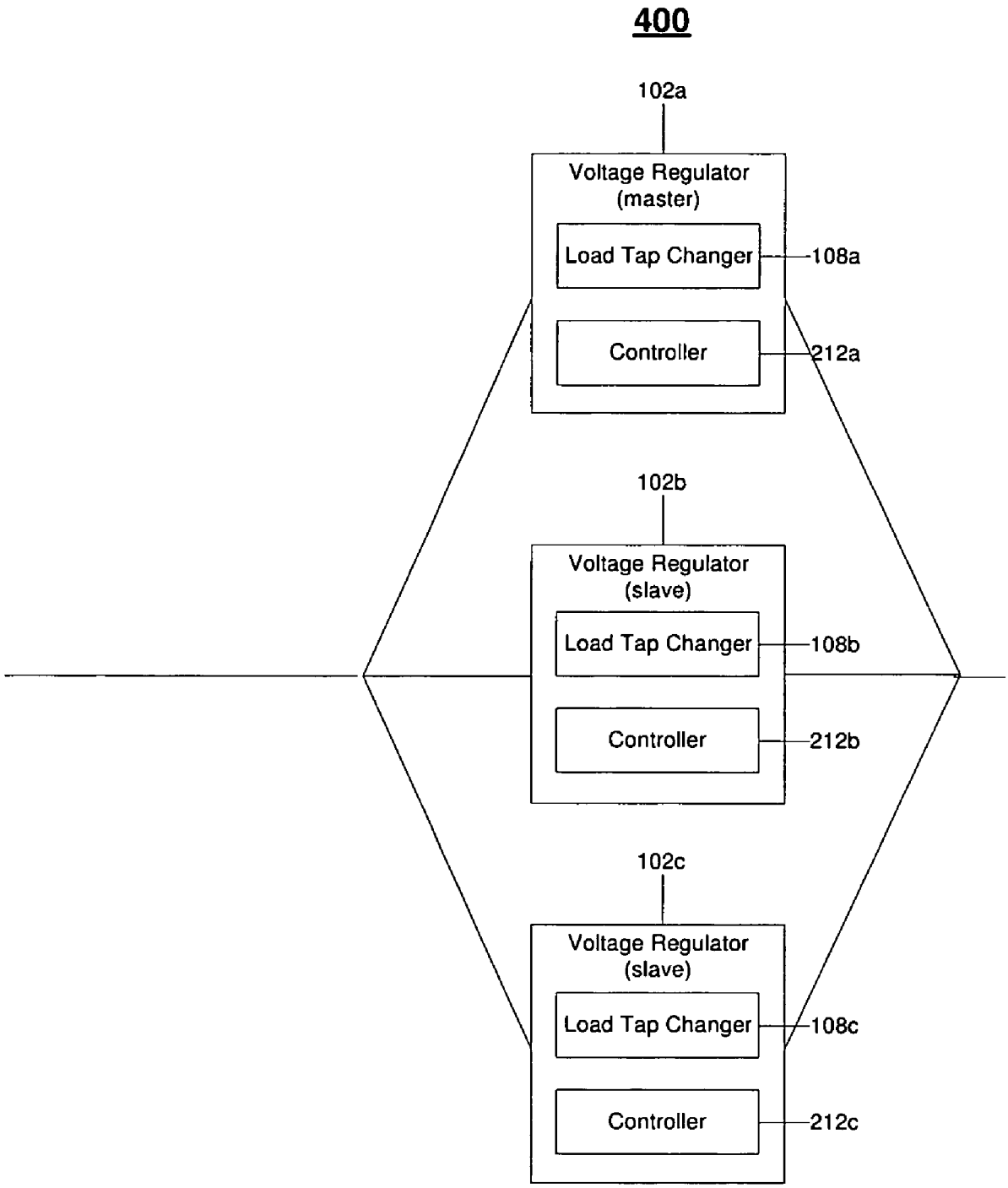
FIG. 4 is a block diagram of a multi-phase electrical system that includes multiple load tap changers.

The controller of the voltage regulator may have an input and an output through which communication with controllers of other voltage regulators may occur. For example, in the multi-phase electrical system 400 shown in FIG. 4, voltage regulators 102*a*-102*c* each include one of the load tap changers 108*a*-108*c*. The voltage regulators 102*a*-102*c* also each include one of the controllers 212*a*-212*c*. One of the voltage regulators, such as the voltage regulator 102*a*, may be designated as a superior voltage regulator, while the other voltage regulators, such as the voltage regulators 102*b* and 102*c*, may be designated as subordinate voltage regulators. In such a configuration, the controller 212*a* may be designated as a superior controller, and the controllers 212*b* and 212*c* may be designated as subordinate controllers. Similarly, the load tap changer 108*a* may be designated as a superior load tap changer, and the load tap changers 108*b* and 108*c* may be designated as subordinate load tap changers. The controller 212*a* of the superior voltage regulator 102*a* may send a signal over the corresponding output that signals the controllers 212*b* and 212*c* of the subordinate voltage regulators 102*b* and 102*c* that the superior controller 212*a* has initiated a preventive maintenance tapping sequence. After receiving this signal on the respective inputs, the controllers 212*b* and 212*c* signal for preventive maintenance tapping sequences in the subordinate load tap changers 108*b* and 108*c*.

In one implementation, a single voltage may be produced on the output of the superior controller 212*a* to indicate that a PMT sequence for the superior load tap changer 108*a* has been initiated. More particularly, a presence of voltage on the output indicates that the PMT sequence has been initiated and that the tap position of the load tap changer 108*a* will be changed. In another implementation, a digital communication may be sent over the output of the controller 212*a*. The digital communication may indicate that the PMT sequence has been initiated and may include details of the change in tap position to be made. The controllers 212*b* and 212*c* of the subordinate voltage regulators 102*b* and 102*c* may use the included details to specify how the tap positions of the subordinate load tap changers 108*b* and 108*c* should be changed. Sending the signals indicating that the PMT sequence has been initiated before the tap position of the superior load tap changer 108*a* has changed enables the load tap changers 108*a*-108*c* to change tap positions at substantially the same time.

Within this feature, the superior controller 212*a* performs the preventive maintenance tapping process 300 based on the internal configuration of the superior load tap changer 108*a*. The subordinate controllers 212*b* and 212*c*, on the other hand, do not perform the preventive maintenance tapping process 300 based on the internal configuration of the subordinate load tap changers 108*b* and 108*c*. Instead, the subordinate controllers 212*b* and 212*c* only initiate a preventive maintenance tapping sequence when the appropriate signal is received from the superior controller 212*a* on inputs of the subordinate controllers 212*b* and 212*c*. In other implementations, a single controller may directly control multiple load tap changers.

The preventive maintenance tapping sequence may be limited by hardware and firmware control settings. For example, if the control function switch of the controller is in the "Off" or "Manual" position, initiation of a preventive maintenance tapping sequence is physically disabled, and will not begin until the control function switch is returned to the "Auto/Remote" position and other criteria for starting a PMT sequence are met. The preventive maintenance tapping range may be limited by physical constraints, such as limit switches on the load tap changer or in the position indicator, and firmware parameters, such as SOFT-ADD-AMP limits and the tap-to-neutral feature. If so, the preventive maintenance tapping sequence does not attempt to exceed those limits. If the tap-to-neutral feature is active, the tap position is not changed.

A user may issue a manual command to cause the tap changer to perform a preventive maintenance tapping operation, using any of the available modes, before the countdown timers have expired. This allows the user to bypass the preventive maintenance tapping process 300 to cause a change in tap position when necessary. In one implementation, the manual command may be issued through the HMI. In another implementation, the command may be issued through a communications device, such as a mobile computing device, that is capable of connecting to the controller of the voltage regulator and signaling for a preventive maintenance tapping operation. In another implementation, a supervisory control and data acquisition (SCADA) system may be used to issue the command to the controller.

The preventive maintenance tapping process may extend the life of the contacts by preventing carbon build up on contact surfaces. The mechanical contact wiping action that takes place during a tap change sequence will reduce the amount of coking that occurs. This will result in lower lifetime maintenance costs and an extended lifetime for the voltage regulator.

Figure 5:
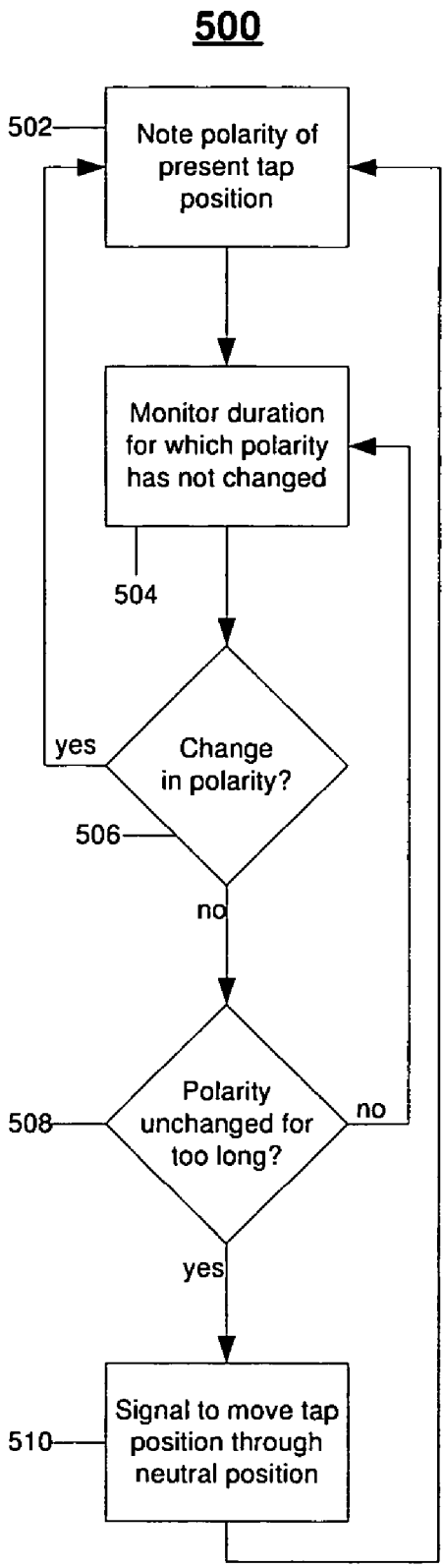

Referring to FIG. 5, a second preventive maintenance tapping process 500 also may be used to prevent carbon buildup on movable contacts and reversing switch contacts of a load tap changer. The preventive maintenance tapping process 500 causes the position of the movable contacts to change when the movable contacts have not passed through a neutral position for longer than a threshold amount of time. In other words, the process 500 ensures that the tap position periodically passes through neutral to change the polarity of the tap position, which prevents carbon buildup on movable contacts of a reversing switch of the load tap changer. The process 500 is executed by, for example, the processor 214 of the controller 212.

Initially, the polarity of the present position of the load tap changer contacts is noted (502). More particularly, the processor may determine whether the present position represents a "raise" or a "lower" from a neutral position of the load tap changer.

The duration for which the polarity of the present position has been maintained also is monitored (504). The duration for which the polarity of the present position has been maintained may be longer than a duration for which the present position has been held. More particularly, one or more previous positions of the load tap changer that are consecutive with the present position and with one another may have the same polarity as the present position. As such, the duration for which the polarity of the present position has been maintained may include the duration for which the one or more previous positions were held. As may be done in the process 300 of FIG. 3, countdown timers may be used to monitor the duration for which the polarity of the present position has been maintained relative to a maximum allowable time between changes in polarity.

The processor 214 determines whether the polarity of the present position of the load tap changer has changed (506). The polarity of the present position may have changed as a result of a change in the tap position, due to a variation in the input voltage or output voltage of the voltage regulator, or for other reasons. However, not all changes to the tap position may cause a change to the polarity of the present position. For example, tap positions, both before and after a change in tap position, may have the same polarity, depending on the distance of the tap positions from the neutral position. If the polarity has changed, then the new polarity is noted (502). In addition, the countdown timer is reset to the maximum allowable time between changes in tap position polarity and is used to monitor the duration for which the polarity of the tap position has not changed (504).

If no change in the polarity of the present position is detected, then the processor 214 determines whether the polarity has not changed for longer than the maximum allowable amount of time (508). If the polarity has had its present value for less than the maximum time, then the processor continues to monitor the time for which the polarity has not changed (504). In general, a countdown timer having a non-zero value indicates that the polarity has not been in its present state for the maximum allowable time.

If the polarity has not changed for longer than the maximum allowable amount of time (i.e., the countdown timer has a value of zero), the processor 214 causes the controller 212 to signal for a preventive maintenance tapping sequence, which causes a change in the tap position of the load tap changer (510). More particularly, the preventive maintenance sequence causes the tap position to be moved through the neutral position such that the polarity of the tap position is changed. In other words, the tap position is changed as described above with respect to the process 300 when mode B is selected.

As described above with respect to the process 300, one or more hardware and firmware control settings and one or more configurable parameters, such as a time-of-day range parameter, a maximum deviation from neutral parameter, or a current limit parameter, may be used to specify or to limit the preventive maintenance tapping sequence. Before the preventive maintenance tapping sequence begins, a time and a date may be recorded by the controller 212. The controller 212 also may communicate with controllers of other voltage regulators to signal for corresponding preventive maintenance tapping sequences.

As may be done with respect to the process 300, a user may issue a manual command to cause the tap changer to perform a preventive maintenance tapping operation before the countdown timers have expired, such that the preventive maintenance tapping process 500 may be bypassed when necessary. The manual command may be issued through the HMI, through a communications device capable of communicating with the tap changer, or through a SCADA system.

In some implementations, both the preventive maintenance tapping process 300 of FIG. 3 and the preventive maintenance tapping process 500 of FIG. 5 may be executed by a processor of a single load tap changer. Executing the process 300 reduces carbon buildup on the main movable contacts of the load tap changer, and executing the process 500 reduces carbon buildup on movable contacts of a reversing switch of the load tap changer. As a result, executing both the process 300 and the process 500 may be used to reduce carbon buildup throughout the load tap changer.

In general, load tap changer contact life previously has been monitored through visual inspection. To do so, a regulator that includes a load tap changer and the associated contacts is removed from service for visual inspection of the contacts. When removed from service, the regulator may be bypassed without being replaced, in which case the circuit voltage is no longer regulated by the voltage regulator, and the equipment on the circuit is exposed to unregulated voltage. The removed regulator also may be bypassed and replaced, which is resource intensive and undesirable if not necessary. If the regulator is not bypassed, the line serviced by the regulator is de-energized, which results in a loss of power to the equipment on the circuit. In addition, the regulator may need to be taken to a service facility for maintenance work, which increases the duration of the power outage.

Monitoring the number of tap change operations in an attempt to determine when contacts should be serviced provides some degree of knowledge about how often arcing events are occurring, but excludes details regarding amount of contact erosion on each arcing edge and the conditions to which the contacts were exposed. The conditions to which the contacts were exposed are important factors in determining the effects of an arcing event on the life expectancy of the contacts.

Figure 6:
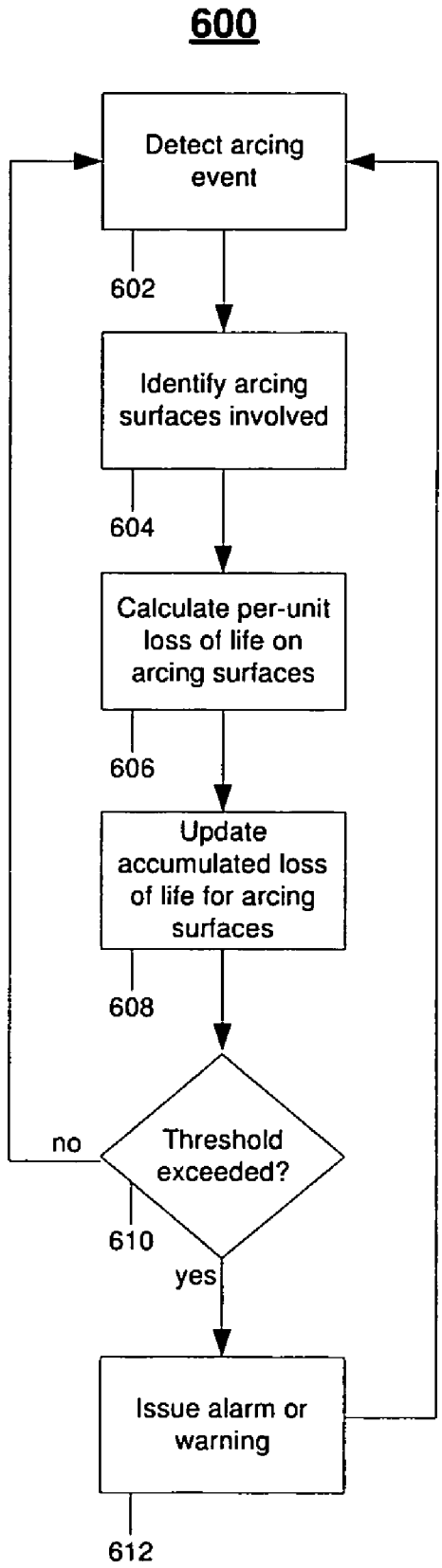
FIG. 6 is a flow chart of a process for duty cycle monitoring of load tap changer contacts.

Referring to FIG. 6, a duty cycle monitoring process 600 estimates lost life for all arcing surfaces of contacts in a load tap changer of a voltage regulator. When the estimated lost life for any arcing surface exceeds user defined thresholds, alarms or warnings are provided by way of a controller of the regulator such that a user may plan for equipment maintenance at an appropriate time to have the aged tap changer contacts replaced. The alarms or warnings provided during the duty cycle monitoring process 600 allow the user to optimally schedule maintenance and avoid service interruptions on circuits connected to the regulator.

The process 600 for calculating accumulated loss of contact life uses data from tap changer contact life testing. From test data on specific tap changer models, contact life can be related to interrupting current and recovery voltage. The magnitudes of these values are functions of circuit parameters, tap position, direction of tap changer travel and design information specific to the regulator.

Arcing events result in a volume of material eroded from contacts involved in the arcing event. If a statistically large number of tap changes at a constant interrupting current and recovery voltage are made starting with new contacts and continuing to complete erosion, an average per-unit loss of life per arcing event may be calculated for that specific interrupting current and recovery voltage. Data points of contact life at different interrupting current and recovery voltage levels enable a set of contact life curves for a specific tap changer model to be created and a contact life equation to be written.

The process 600 begins with the detection of an arcing event (602). An arcing event occurs with every tap change, so the controller identifies the arcing event by detecting a tap change. During a tap change, current is interrupted at a first arcing surface and established at a second arcing surface, but service to the circuit to which the regulator is connected is not interrupted at this time. As current is interrupted at the first arcing surface, an arc occurs, which erodes a portion of the contact material volume.

Arcing surfaces involved in the detected arcing event are identified so that the per-unit loss of life caused by the arcing event may be attributed to those arcing surfaces (604). Arcing surfaces of two types of tap changer contacts, movable contacts and stationary contacts are considered. The movable contacts make electrical contact with appropriate stationary contacts to adjust a turns ratio of the regulator such that a relatively constant regulated voltage is maintained. The load tap changer includes two sets of movable contacts, and each set of movable contacts includes two arcing surfaces. In addition, each stationary contact has two arcing surfaces. All arcing surfaces of the movable and stationary contacts are monitored during the process 600. One movable and one stationary arcing surface are involved in each arcing event. When a tap change is made, the controller identifies the movable and stationary contact arcing surfaces involved in the arcing event based on the tap changer position prior to the tap change and the direction of travel of the tap changer.

After the involved arcing surfaces are identified, the interrupting current and recovery voltage are calculated by the controller. As stated previously, the magnitudes of the interrupting current and the recovery voltage are functions of circuit parameters, tap position, direction of tap changer travel and design information specific to the regulator. Circuit parameters are provided to the controller by ancillary devices such as potential or current transformers. Tap position and direction of travel are detected by the controller through signals provided by the tap changer. Specific regulator design information is provided as an input to the controller.

The per-unit loss of contact life for the arcing surfaces involved in the arcing event is calculated using a contact life equation (606). The contact life equation was developed using contact life test data for specific tap changer models, as described above. The contact life equation is a function of interrupting current and recovery voltage and uses constants determined from the contact life test data.

The per-unit loss of life for the specific arcing surfaces is calculated and accumulated for both movable and stationary contacts in memory maintained by the controller. Subsequent events are cumulative, and a loss of life resulting from an arcing event is added to the running estimates of lost life for every arcing surface involved in the arcing event. For each contact arcing surface involved in the arcing event, the new accumulated estimates of lost life for each contact is stored in the memory of the controller (608).

The updated estimates of lost life are checked against user defined threshold values (610). If the accumulated estimate for any arcing surface exceeds a user-defined threshold value, the regulator signals by way of the controller that user action is required (612). For example, the controller may indicate that a threshold has been exceeded through the HMI, SCADA, or through operation of a set of alarm contacts. In one implementation, two user-defined thresholds are used. One threshold is intended to indicate to the user that equipment maintenance needs to be scheduled. A second threshold is set at a higher level and is intended to notify the user that a service interruption caused by the regulator may be imminent. After a warning or alarm is given, the process 600 continues and loss of life continues to be accumulated. If no accumulated estimate of lost life exceeds any threshold level, no alarms or warnings are given, and the process 600 continues.

The duty cycle monitoring process 600 is executed for each arcing event that occurs within the tap changer. Monitoring the lost life of the contact arcing surfaces and signaling when thresholds are exceeded results in improved maintenance scheduling and less service interruptions caused by complete erosion of the tap changer contacts. The user may reset the estimates of lost life of all arcing surfaces after the contacts are replaced and the regulator is returned to service. In addition, a user may input initial accumulated estimates of lost life for the arcing surfaces when a controller is placed on a regulator that has been in service for some time such that the tap changer has experienced arcing. In such a case, the user specifies the accumulated estimates of lost life on the contact arcing surfaces and inputs the estimates into the controller.

In other implementations, the remaining arcing surface life may be estimated instead of the accumulated loss of life. In such an implementation, the calculated per-unit loss of life for the contacts involved in the detected arcing event is subtracted from the estimate of remaining arcing surface life for the involved arcing surfaces. In addition, the controller may estimate a date on which maintenance is needed or a date of the end of life for a contact. More particularly, historical parameters including regulator loading, voltage levels, tap changer activity, and tap range may be monitored used to calculate an average loss of life per arcing event for the involved arcing surfaces. The contact life equation may be used to calculate an expected remaining life of the contact arcing surfaces. A maintenance or end of life date then may be calculated using the typical circuit and tap changer activity values, assuming tap changer activity and circuit parameters remain fairly constant since historical values are used.

A voltage regulator is used throughout to refer generically to an electrical device that detects a voltage on an input and produces a corresponding, regulated voltage on an output. The voltage regulator may be a step-type voltage regulator or an induction-type voltage regulator. Furthermore, the term "voltage regulator" may refer to a transformer that transforms a voltage detected on an input into a voltage on an output. The transformer may be a load tap changing (LTC) transformer or a tap changing under load (TCUL) transformer. The voltage regulator may be, for example, a single-phase regulator, a multi-phase regulator, an auto-transformer regulator, or a two-winding regulator. The tap of the voltage regulator may include any number of steps, including zero, as in the case of an induction-type regulator.

It will be understood that various modifications may be made. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A method for automatically changing the tap position in a load tap changer, the method comprising:

noting a polarity of a first tap position of a load tap changer;

noting a duration for which one or more consecutive tap positions of the load tap changer collectively have had the noted polarity, the one or more consecutive tap positions including the first tap position;

comparing the duration for which the one or more consecutive tap positions collectively have had the noted polarity to a threshold value; and changing from the first tap position to a second tap position with a polarity that is different than the noted polarity when the duration for which the one or more consecutive tap positions collectively have had the noted polarity is longer than the threshold value.

2. The method of claim 1 wherein noting a duration for which one or more consecutive tap positions collectively have had the noted polarity comprises noting the value of a countdown timer.

3. The method of claim 2 wherein the countdown timer is reset to the threshold value after a change to a tap position that has a polarity that is not the noted polarity.

4. The method of claim 2 wherein comparing the duration for which the one or more consecutive tap positions collectively have had the noted polarity to the threshold value comprises determining whether the value of the countdown timer is zero.

5. The method of claim 1 further comprising changing from the second tap position to the first tap position.

6. The method of claim 1 wherein changing from the first tap position to the second tap position comprises changing from the first tap position to a second position that is one position from a neutral tap position.

7. The method of claim 1 further comprising changing from the second tap position to a third tap position that has a polarity that is different from the polarities of the first and second tap positions.

8. The method of claim 1 further comprising recording information indicating the change from the first tap position to the second tap position.

9. The method of claim 1 further comprising generating a signal indicating that the first tap position is to be changed when the duration for which the one or more consecutive tap positions collectively have had the noted polarity is larger than the threshold value.

10. The method of claim 1 wherein changing from the first tap position to the second tap position further comprises:

noting a present time;

checking if the present time is within a specified range of times during which a change in tap position may occur;

when the present time is not within the specified range, monitoring the present time until the present time is within the specified range; and changing from the first tap position to the second tap position only after the present time is within the specified range.

11. The method of claim 1 wherein changing from the first tap position to the second tap position further comprises:

checking if the first tap position is within a specified range of positions within which a tap change can occur;

when the first tap position is not within the specified range, monitoring the first tap position until the first tap position is within the specified range; and changing from the first tap position to the second tap position only after the first tap position is within the specified range.

12. The method of claim 1 wherein changing from the first tap position to the second tap position further comprises:

measuring a magnitude of load current flowing through the load tap changer;

checking if the magnitude is less than a threshold value;

when the magnitude is not less than the threshold value, monitoring the magnitude until the magnitude is less than the threshold value; and changing from the first tap position to the second tap position only after the magnitude is less than the threshold value.

13. The method of claim 1 wherein changing from the first tap position to the second tap position comprises:

verifying that operating conditions of the load tap changer meet criteria for allowing a change in tap position; and changing from the first tap position to the second tap position when the criteria are met.

14. The method of claim 1 further comprising:

receiving a signal indicating that a change from the first tap position should occur; and changing from the first tap position to the second tap position in response to the signal.

15. A system for automatically changing the position of movable contacts of a load tap changer, the system comprising:

a processor operable to determine polarities of positions of movable contacts in a load tap changer of a voltage regulator and a duration for which one or more consecutive positions of the movable contacts have had a common polarity; and an actuator operable to change the position of the movable contacts;

wherein the actuator changes the position of the movable contacts in response to a signal from the processor that the position is to be changed because the one or more consecutive positions of the movable contacts have had the common polarity for longer than a threshold value.

16. The system of claim 15 wherein the processor accesses a clock to determine the duration for which the one or more consecutive positions have had the common polarity and to determine if the one or more consecutive positions have had the common polarity for longer than the threshold value.

17. The system of claim 15 further comprising a memory operable to store data specifying the positions of the movable contacts and the changes to the positions of the movable contacts.

18. The system of claim 15 wherein:

the processor is operable to determine a present time; and the processor signals for a change in the position of the movable contacts if the present time is within a specified daily time period.

19. The system of claim 15 wherein:

the processor is operable to obtain a measurement of the magnitude of the load current flowing through the voltage regulator; and the processor signals for a change in the position of the movable contacts if the current measurement is below a threshold value.

20. The system of claim 15 wherein:

the processor is operable to send a signal to a subordinate processor and receive a signal from a superior processor;

the processor sends a signal to the subordinate processor before each change in the position of the movable contacts as a result of the one or more consecutive positions having had the common polarity for longer than the threshold value, wherein the signal instructs the subordinate processor to cause a change in a position of movable contacts associated with the subordinate processor; and the processor receives a signal from the superior processor and causes a change in the position of the movable contacts in response to the signal.

* * * * *